US005413344A

United States Patent [19]

Darden

[11] Patent Number: 5,413,344

[45] Date of Patent: May 9, 1995

[54] PORTABLE BUMPER GOLF SYSTEM

[76] Inventor: Hardy F. Darden, 826 - 95th Ave., North, Naples, Fla. 33963

[21] Appl. No.: 237,581

[22] Filed: May 3, 1994

[51] Int. Cl.[6] ..... A63B 67/02

[52] U.S. Cl. ..... 273/176 E; 273/176 F; 273/176 H

[58] Field of Search ..... 273/195 R, 178 R, 178 B, 273/176 FB, 176 G, 87 R, 87 A, 87 B, 87 C, 176 E, 176 F, 176 H, 126 R, 108, 113, 118 R, 123 R; 473/18, 20, 29, 31, 32, 10, 8, 15, 7

[56] References Cited

U.S. PATENT DOCUMENTS

| | | | |
|---|---|---|---|
| 462,870 | 11/1891 | Mercer | 273/123 R |
| 1,856,816 | 5/1932 | Luddy | 273/176 F |
| 2,025,183 | 12/1935 | Stayton | 273/176 F |
| 3,360,265 | 12/1967 | Yabroudy | 273/87 R |
| 3,690,674 | 9/1972 | Taylor | 273/176 G |
| 3,735,988 | 5/1973 | Palmer | 273/176 H |
| 3,857,567 | 12/1974 | Goldfarb | 273/127 R |
| 3,892,412 | 7/1975 | Koo | 273/178 B |
| 4,647,046 | 3/1987 | Hurt | 273/176 E |
| 4,978,127 | 12/1990 | Juel | 273/176 H |
| 5,002,280 | 3/1991 | Hines | 273/176 H |

*Primary Examiner*—Sebastiano Passaniti
*Attorney, Agent, or Firm*—Oldham & Oldham Co.

[57] ABSTRACT

The invention is directed to a bumper golf game wherein each hole is different from all others, providing unique playing characteristics. The invention uses durable materials in its construction, which are immune or resistant to the effects of water, extreme temperatures and UV radiation. The playing surface is a synthetic carpet especially made for outdoor use.

2 Claims, 4 Drawing Sheets

PORTABLE BUMPER GOLF SYSTEM

The invention described in this specification is the subject of Invention Disclosure Document No. 326,587.

TECHNICAL FIELD

The present invention relates to a portable bumper golf game. More particularly, the invention relates to a miniature golf system that is easily constructed, challenging, conveniently transportable and durable. Each hole of the system is independently constructed of durable and rigid materials and has no moving parts. The units can be neatly stacked on a truck or trailer for transport, and the system can be set up for use in a short period of time since assembly and adjustment steps are kept to a minimum. A typical system would be comprised of a number (usually nine) of different holes, but a complete inventory could include many more individually unique and different holes. Thus a nine-hole system could readily be tailored to the preferences and degree of difficulty desired by those who will be using the system at a given time. The foregoing characteristics are particularly attractive to those who will be operating the games at many different locations.

BACKGROUND OF THE INVENTION

There are, of course, numerous miniature golf games, permanent and portable, in use and otherwise know in the prior art, U.S. Pat. No. 5,067,716 discloses a self-contained system wherein all playing greens are attached to a transport means, and remain so attached during play. A portable miniature golf board game is disclosed in U.S. Pat. No. 4,098,507. The board game has a single green, but it does offer the option of playing any one of three holes. Portable golf games having a single green and a single hole are disclosed in U.S. Pat. No. 4,596,391 and in U.S. Pat. No. 3,944,232. A combination of golf and billiards is disclosed in U.S. Pat. No. 4,957,388 wherein a golf ball and putter are used to play on a pool table type setting. U.S. Pat. No. 4,877,250 discloses a portable putting course containing a single green having a plurality of holes. None of the foregoing games provides the combination of variety, portability and durability that is provided by the bumper golf system of the present invention.

SUMMARY OF THE INVENTION

It is an object of the present invention to provide a unique and improved bumper golf game that is unique and interesting to play due to the variety of holes offered.

Another object of the present invention is to provide a bumper golf game that can easily be transported, and readily set up for play at any of various locations.

Still another object of the present invention to provide a bumper golf game that is durable and resistant to the detrimental effects of various outdoor environmental conditions such as water, extreme temperatures and UV rays.

These and other objects of the present invention are achieved by a bumper golf game wherein each hole is different from all others. Each hole is independently and sturdily constructed in such a manner as to allow for convenient transport and quick set-up of the system at any suitable location.

A major aspect of the invention is the durability of the materials used in its construction. Most known miniature golf systems are used and/or stored out of doors, and are therefore subjected to various detrimental environmental conditions that promote degradation of the materials of which they are made. All materials used in construction of the present invention are immune or resistant to the effects of water, extreme temperatures and UV radiation. The sides, ends, braces and floor are made from ¼ inch and ½ inch sheet plastic. One especially satisfactory material is cutting board stock made by C & K Manufacturing & Sales in Westlake, Ohio. The playing surface is a synthetic carpet especially made for outdoor use. Screws used in assembling the units are made of corrosion-resistant aluminum or stainless steel.

DETAILED DESCRIPTION OF THE INVENTION

Figure 1:
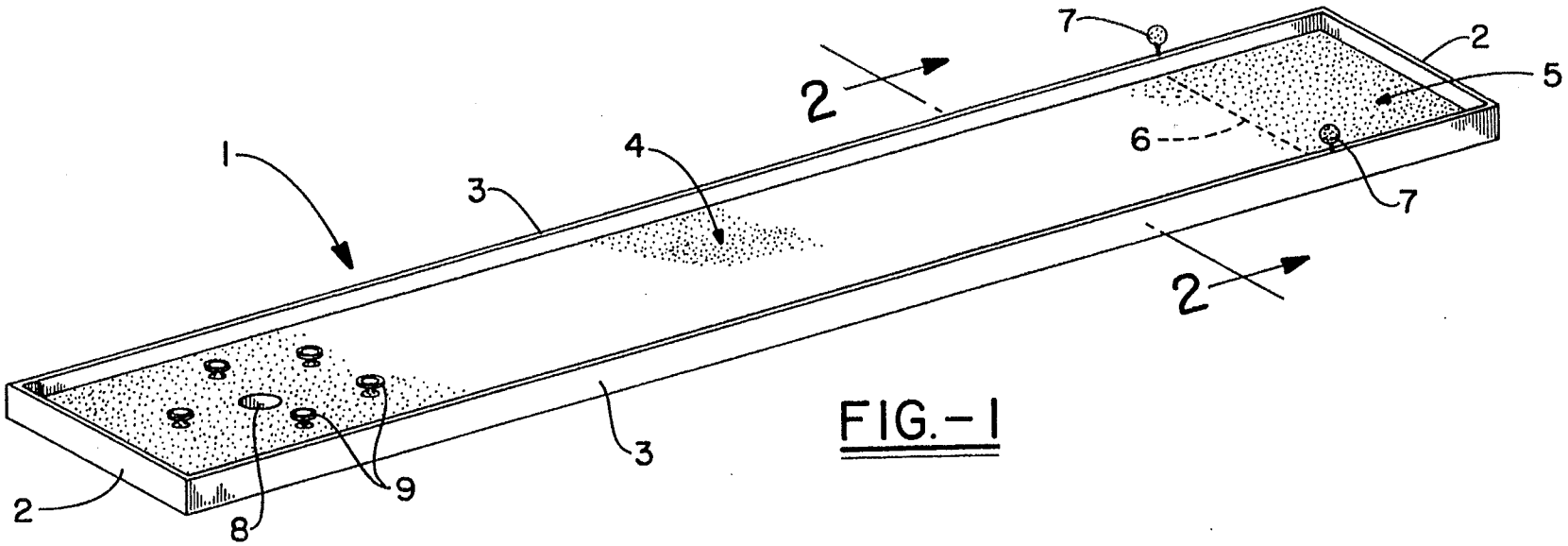
FIG. 1 is a general perspective view of a representative hole, or unit, of the bumper golf system.

FIG. 1 illustrates a typical hole, designated generally as 1. Ends 2 and sides 3 are joined to form the boundaries of the hole, and the base, or floor, for the playing surface 4 is placed at a plane below the top edge of the sides and ends. The sides and ends thus act as a border and confine the ball in the playing area. The structure is shown in more detail in FIGS. 2 and 3.

The tee box 5, where the ball is placed in play, is defined by broken line 6 and can optionally be marked by any appropriate means. One such means is a golf ball on a tee on the top edge of side 3. At the opposite end of the hole is cup 8 having one or more bumpers 9 placed nearby to make it more difficult to put the ball in the cup.

Figure 2:
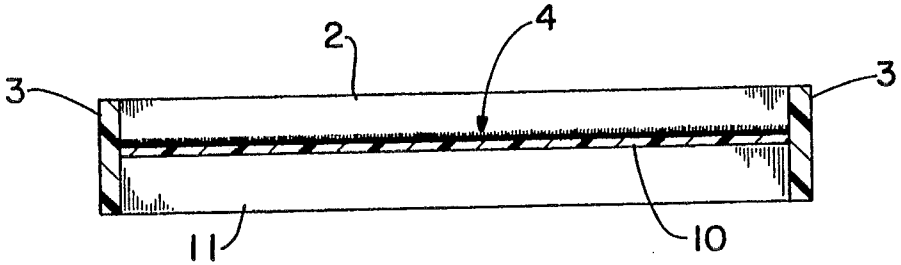
FIG. 2 is a sectional view taken across the lines 2—2 of FIG. 1.

FIG. 2, a cross-sectional view across the lines 2—2 of FIG. 1, shows details of construction. The floor 10 of the playing surface is fixed at a level between the upper and lower edges of sides 3. The floor is flexible to a limited degree to allow for variations in the level of the playing surface (see FIGS. 11 and 13, for example), which variations will cause rolls and contours along the length of holes as selectively desired. The floor is supported by, and rests on top of horizontal brace, or stringer, 11. A plurality of braces, or stringers, are provided as needed to provide necessary support for the floor along the length of the unit. It is the variations of the height along each stringer which will provide for rolls and contours in the playing surface because of the inherent flexibility of the floor 10. The floor 10 is secured to the stringers 11 by adhesive or other suitable means. Playing surface 4 is a weather resistant carpet material such as a miniature golf carpet. A typical unit would be about 2 feet by 8 feet having sides and ends of ½ inch thick material and a height of 4 inches. The braces, or stringers, are typically 2 inches high, the floor ¼ inch thick and the carpet ⅛ inch thick, thus causing the top of the carpet to be about 1⅝ inches below the top edge of the sides and ends. The dimensions are not critical, but it is convenient to have the sides and ends at a sufficient height above the playing surface to provide a barrier around the playing surface to prevent the ball going out of bounds, and also because it is desirable to have the playing surface only about 2 inches above the surface upon which each hole is positioned to be played to facilitate playing the game by a player.

Figure 3:
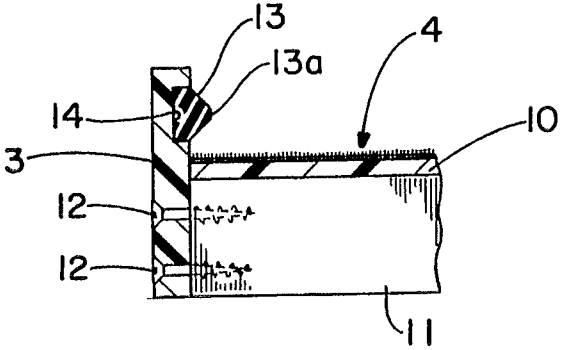
FIG. 3 is a detailed view showing how the sides and floor are assembled.

FIG. 3 shows additional details of construction of the units. Sides 3 are attached to braces 11 by means of rust-resistant screws 12 which are typically either aluminum or stainless steel. Floor 10 can also be attached to braces 11 by similar means.

An optional feature that can be provided around at least part of the interior side wall is a linear bumper 13. The bumper, usually a rubber material having a triangular cross section, is adhesively or otherwise attached in a groove 14 in the face of side 3. The linear bumper can be placed around the entire periphery of the unit, or it can be placed only in certain places as desired. Typically, the bumper will be provided at locations in close proximity to the cup. It is important that the height of the linear bumper (i.e., the vertical distance from point 13*a* to the top surface of carpet 4) be within a specified range. The placement of the bumper should be such that the ball contacts point 13*a* at a point about the middle of the ball or at its largest circumference. For a conventional golf ball, the point of contact can be in the range of about 50/64 inch to about 55/64 inch above the playing surface in the preferred embodiment. The height of the bumper is such that the point of contact is at the widest circumference of the ball, or slightly above the circumference of the ball. Contact of the circumference of the ball with the linear bumper at, or just below point 13*a* provides a good rollback. If point 13*a* is too high or too low the ball will skip rather than roll smoothly across the playing surface after striking the bumper.

Figure 4:
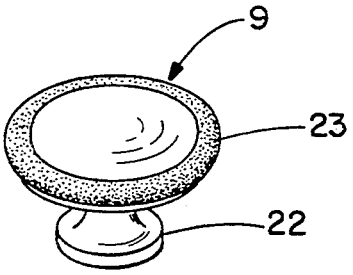
FIG. 4 is a perspective view of a bumper used as an obstacle on the playing surface.

FIG. 4 is a perspective view of a bumper assembly 9 comprising a rigid core member 22 and a tire-like member 23 surrounding a portion of the core. The core is commonly a molded hard plastic, but could also be fabricated from a metal, wood or other suitable material. The tire-like member is usually made from a rubber.

Figure 5:
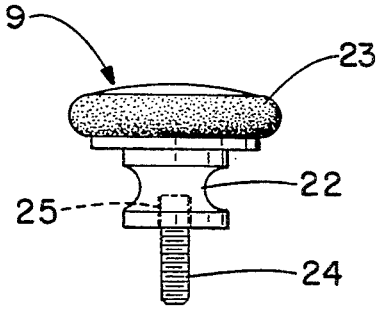
FIG. 5 is a plan view of a bumper.

FIG. 5 is a plan view of bumper assembly 9. At the bottom of core 22 is a threaded shaft 24 that is embedded in the core as shown by broken lines 25. The threaded shaft is inserted through a hole in the floor 4 at any desired location, and the bumper assembly is secured by a nut, not shown.

Figure 6:
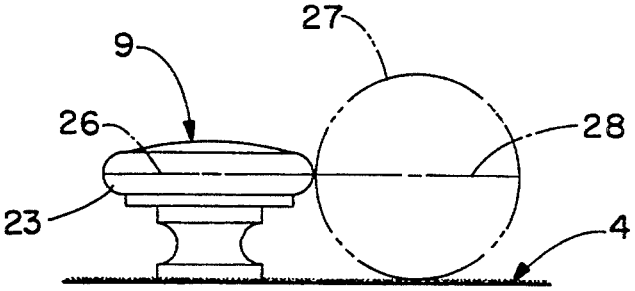
FIG. 6 shows the relationship of a bumper and a golf ball in close proximity to each other.

FIG. 6 shows a bumper assembly 9 and a conventional golf ball 27 in close proximity to each other as they will frequently be when the game is being played. Line 26 represents the circumference of the tire in the bumper assembly, and line 28 represents the circumference of ball 27. The height of the bumper assembly should be such that line 26 is in the range of about 50/64 inch to about 55/64 inch above the playing surface. Ideally, line 26 is in the same plane with, or slightly higher than line 28 on the ball such as a distance of about 1/64 inch. Proper alignment of the bumper assembly with respect to the ball assures a proper roll-back after the ball strikes the bumper assembly in the same manner as previously described with respect to the linear bumper in FIG. 3.

Figure 7:
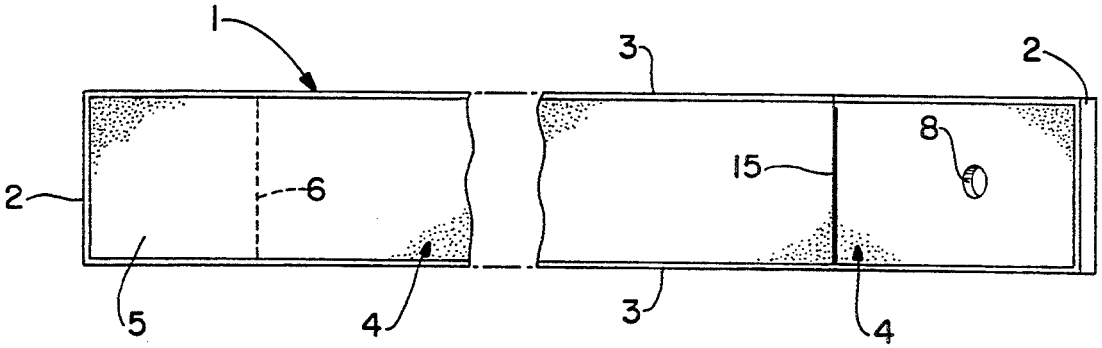
FIGS. 7 and 8 are top and side plan views of a non-limiting example configuration non-limiting, for a playing hole to make up the bumper golf system of the present invention.
Figure 8:
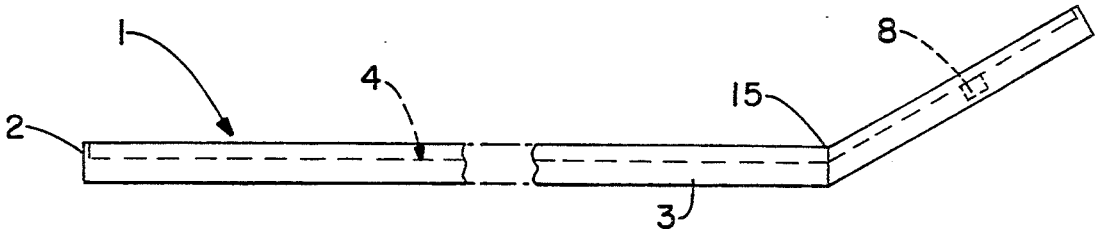

FIGS. 7 and 8 show one of the many optional plans that can be used for each unit of the system of the present invention. As can be seen graphically in FIG. 8, a portion of the unit at one end, and containing the cup, is angled upward at point 15, resulting in cup 8 being located on an incline.

Figure 9:
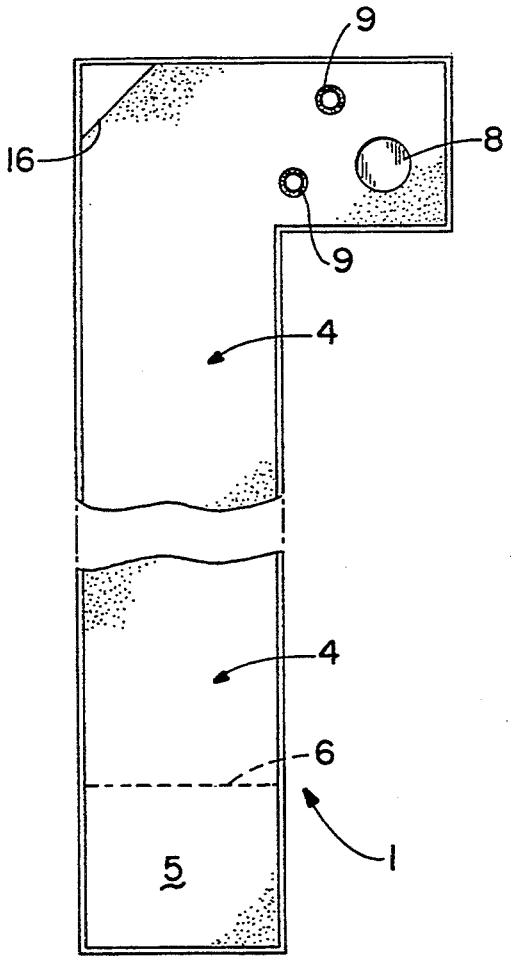
FIG. 9 is a top plan view of a further example configuration for a playing hole.

FIG. 9 shows a hole having a dogleg right, and, of course, an alternative to this is a dogleg left.

Figure 10:
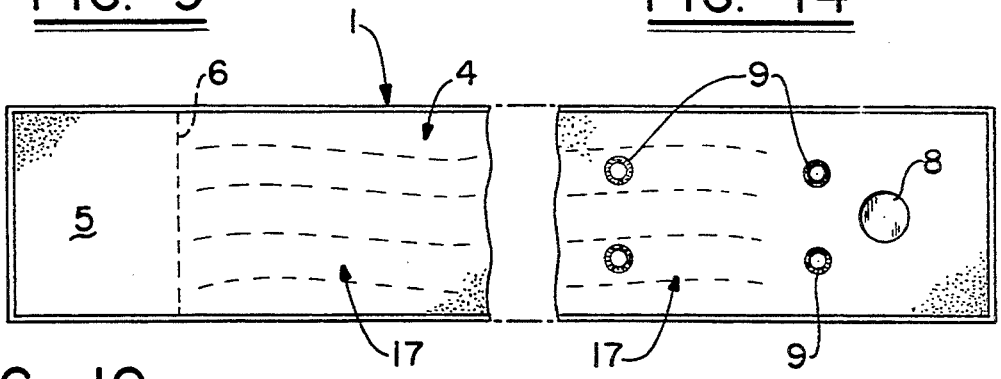
FIGS. 10 and 11 show top and side plan views of a further example for a playing hole.
Figure 11:
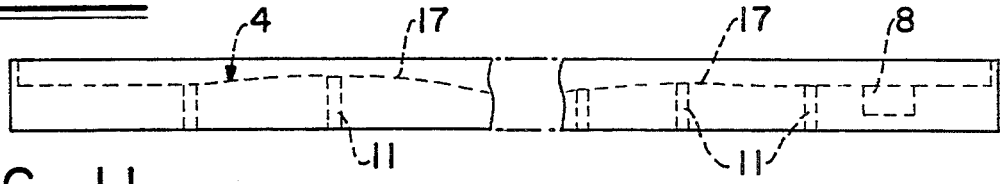

FIGS. 10 and 11 show a plan having to hills 17 between the tee box and the cup. As mentioned earlier, floor 4 is flexible, and the hills are made by using braces 11 of varying heights as illustrated particularly in FIG. 11.

Figure 12:
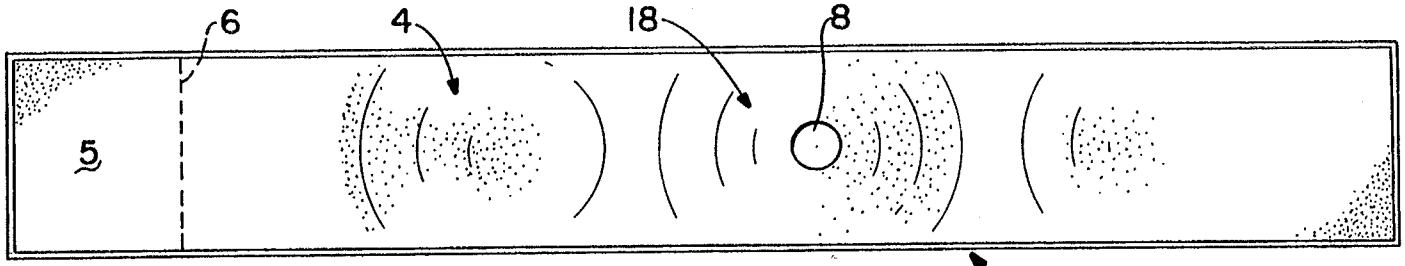
FIGS. 12 and 13 show top and side plan views of a further example of a playing hole in accordance with the invention.
Figure 13:
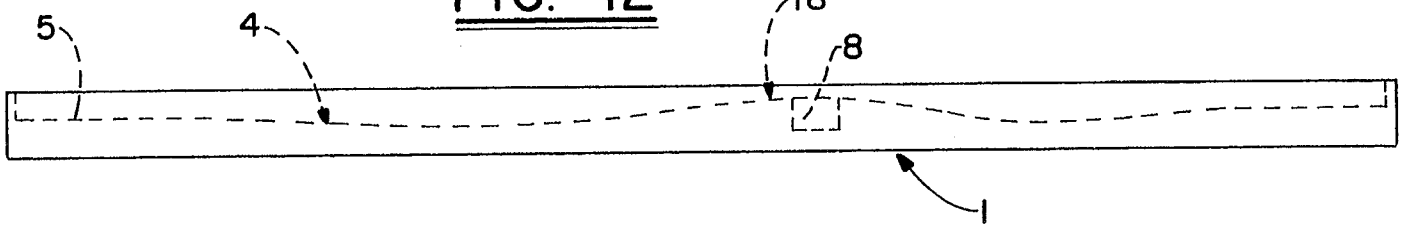

FIGS. 12 and 13 show a further example of the type of holes which may form a part of a "course" constructed in accordance with the invention.

Figure 14:
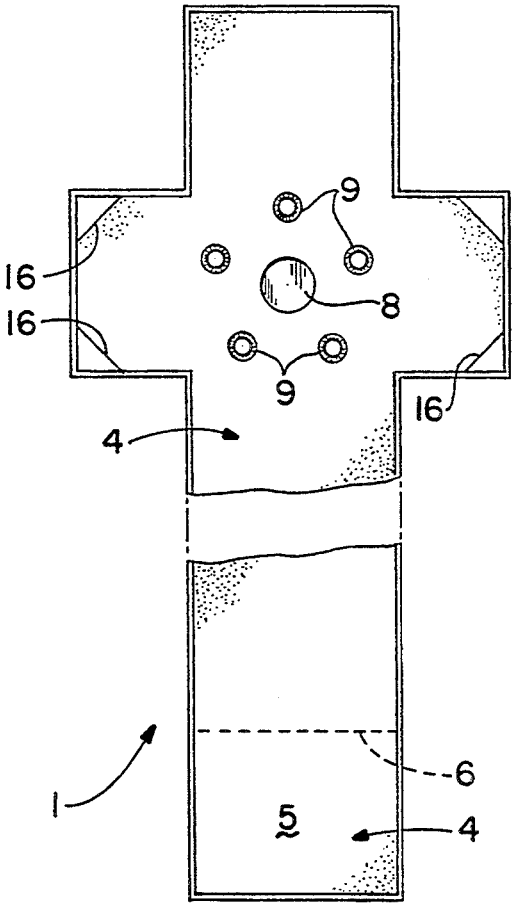
FIGS. 14 and 15 show top plan views of further examples of playing holes to make up the bumper golf system of the invention.
Figure 15:
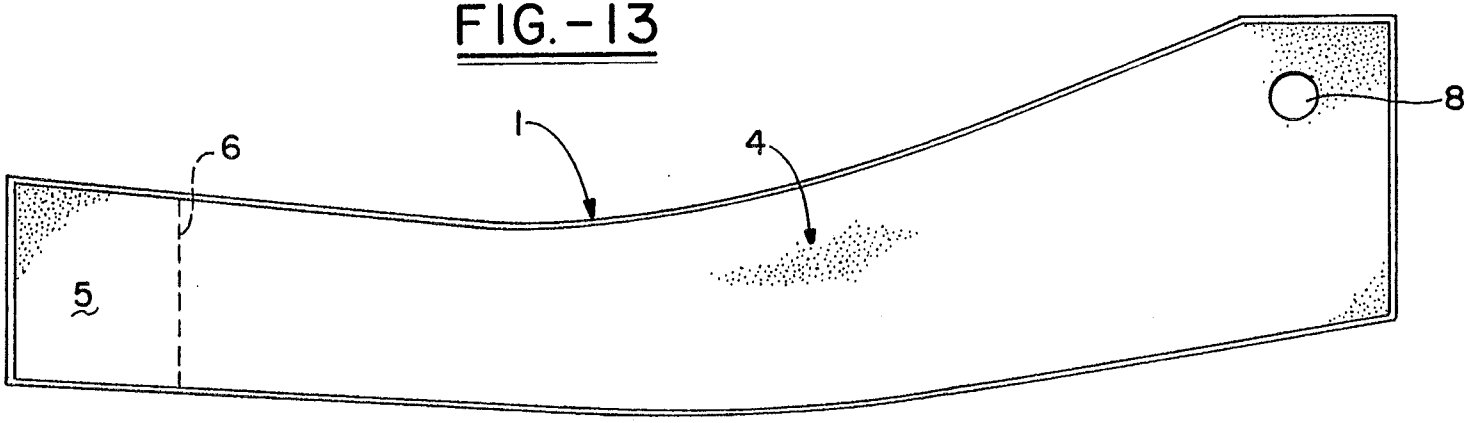

FIGS. 14 and 15 show additional variations of designs wherein the differences from previously described ones are self-evident. Many additional designs are also within the range of this specification, and should not be considered to be patentably distinct therefrom.

In compliance with the statutes, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

What is claimed is:

1. A portable, combination system comprising a plurality of holes for playing a game of miniature bumper golf wherein:

each of the holes is constructed independently of all others, each is physically separated from all others, and each hole in the system has a design different from all other holes in the system;

each of the holes has a long dimension and a short dimension and a playing surface which is supported by a floor and is surrounded by sides and ends, at least some of said sides and ends projecting vertically above the level of the playing surface, thus acting as a border to confine the ball to the playing surface;

the playing surface of each hole includes a cup that projects downward from the playing surface and has an upper edge substantially flush with the playing surface;

the majority of the playing surfaces further include at least one substantially round resilient bumper of such height that the point at which the ball contacts a bumper is in a range about the middle portion of the ball, said bumper positioned on the playing surface so as to obstruct the path to the cup;

the sides and ends of each hole includes a resilient linear bumper on at least part of the inner face of said sides and ends, and positioned such that the point at which the ball contacts the bumper is in a range about the middle portion of the ball; and wherein all structural components of each hole are fabricated from a hard plastic and are joined by aluminum or stainless steel fastening devices, wherein the playing surface further includes a synthetic carpet which is adhesively secured to the floor.

2. The system according to claim 1 wherein the sides and ends are made of a plastic material about $\frac{1}{2}$ inch thick and is substantially rigid, and the floor is made of a plastic material that is between about $\frac{1}{8}$ and about $\frac{3}{8}$ inch thick and is fairly flexible, and further wherein plastic stringers extend between the sides and may be selectively of differing height such that with the floor secured to the stringer, the floor will selectively curve and undulate along the length between the sides.

* * * * *